US009211002B2

(12) United States Patent
Lo

(10) Patent No.: US 9,211,002 B2
(45) Date of Patent: Dec. 15, 2015

(54) SYSTEM AND APPARATUS FOR STORING AND ORGANIZING ITEMS

(71) Applicant: Michael (Zi-Qiang) Lo, Shenzhen (CN)

(72) Inventor: Michael (Zi-Qiang) Lo, Shenzhen (CN)

( * ) Notice: Subject to any disclaimer, the term of this patent is extended or adjusted under 35 U.S.C. 154(b) by 60 days.

(21) Appl. No.: 13/947,834

(22) Filed: Jul. 22, 2013

(65) Prior Publication Data

US 2015/0021286 A1 Jan. 22, 2015

(51) Int. Cl.

| | |
|---|---|
| ***A47G 29/08*** | (2006.01) |
| ***A47F 5/08*** | (2006.01) |
| ***A47B 43/00*** | (2006.01) |
| ***A47B 47/00*** | (2006.01) |
| ***A47B 57/00*** | (2006.01) |
| ***A47B 55/06*** | (2006.01) |
| ***A47F 5/11*** | (2006.01) |
| ***A47B 47/06*** | (2006.01) |
| ***A47B 43/02*** | (2006.01) |
| ***A47B 61/00*** | (2006.01) |
| *A47B 43/04* | (2006.01) |
| *A47B 96/02* | (2006.01) |
| *A47B 96/04* | (2006.01) |

(52) U.S. Cl.

CPC ..... *A47B 43/00* (2013.01); *A47B 43/02* (2013.01); *A47B 47/06* (2013.01); *A47B 55/06* (2013.01); *A47B 61/00* (2013.01); *A47F 5/116* (2013.01); *A47B 43/04* (2013.01); *A47B 96/025* (2013.01); *A47B 96/04* (2013.01)

(58) Field of Classification Search

CPC ..... A47B 43/02; A47B 96/04; A47B 43/00; A47B 47/06; A47B 43/04; A47B 47/0091; A47B 96/025; A47B 7/08; A47B 81/00; A47B 85/00; A47B 61/00; A47B 61/003; A47B 61/06; A47B 55/06; A47B 57/00; A47B 47/00; A47B 47/0075; A47B 88/20; A47B 43/003; A47B 45/00; A47B 46/00; B65D 2519/00159; B65D 2519/00124; B65D 5/52; B65D 5/48012; B65D 5/48004; B65D 5/48; B65D 7/065; B65D 25/06; B65D 25/04; B65D 90/0066; B65D 88/62; B65D 90/046; B65D 5/48026; B65D 5/48038; B65D 5/4804; B65D 5/22; B65D 5/28; D06F 57/08; A47F 5/112; A47F 5/116; A47F 5/11; A47F 5/10; A47F 5/105; B65F 1/0046; B65F 1/02; B65F 1/04; B65F 1/06; B65F 1/08

USPC ..... 211/186, 195, 149, 72, 73, 184, 113, 211/175; 229/120.31, 120.38; 220/531, 220/530, 529, 552, 551

See application file for complete search history.

(56) References Cited

U.S. PATENT DOCUMENTS

| | | | | | |
|---|---|---|---|---|---|
| 1,349,634 | A | * | 8/1920 | Stern | 190/12 A |
| 1,930,348 | A | * | 10/1933 | Parrott | 312/239 |
| 2,185,513 | A | * | 1/1940 | Middleton | 312/281 |
| 2,728,482 | A | | 12/1955 | Driver | |

(Continued)

*Primary Examiner* — Jennifer E Novosad

(74) *Attorney, Agent, or Firm* — Hush Blackwell LLP

(57) ABSTRACT

A storage system including first and second spaced apart side panels, with top and bottom panels extending between the side panels generally adjacent to the top and bottom of the side panels respectively. The storage system additionally includes a plurality of intermediate panels positioned between the side panels and between the top and bottom panels, with the intermediate panels defining a plurality of compartments. The storage system may include at least one partition capable of being folded within at least one compartment to present at least three variations of sub-compartment arrangements within the compartment.

18 Claims, 8 Drawing Sheets

(56) References Cited

U.S. PATENT DOCUMENTS

| | | | | | |
|---|---|---|---|---|---|
| 3,079,040 | A | | 2/1963 | Vesak | |
| 3,201,022 | A | | 8/1965 | Glassco et al. | |
| 3,403,835 | A | * | 10/1968 | Schwaner | 229/120.37 |
| 3,822,785 | A | | 7/1974 | Getz et al. | |
| 4,223,827 | A | * | 9/1980 | Gilbert | 206/521 |
| 4,429,932 | A | * | 2/1984 | Brennan | 312/259 |
| 4,951,867 | A | * | 8/1990 | McManus | 229/120.31 |
| 5,379,906 | A | * | 1/1995 | Levin et al. | 211/195 |
| 5,624,032 | A | * | 4/1997 | Yucknut et al. | 206/433 |
| 5,775,496 | A | | 7/1998 | Cyr | |
| 5,842,571 | A | | 12/1998 | Rausch | |
| 5,868,306 | A | * | 2/1999 | Wen-Tsan | 229/120.07 |
| 5,967,406 | A | * | 10/1999 | Moorman | 229/120.37 |
| 6,318,822 | B1 | | 11/2001 | Wang | |
| 6,640,944 | B2 | | 11/2003 | Adams | |
| 6,719,157 | B2 | | 4/2004 | Stoddart et al. | |
| 6,732,659 | B2 | | 5/2004 | Poon | |
| 8,033,405 | B2 | * | 10/2011 | Wang | 211/118 |
| 8,540,089 | B2 | * | 9/2013 | Wang | 211/118 |
| 2003/0111434 | A1 | | 6/2003 | Stoddart et al. | |
| 2004/0251795 | A1 | | 12/2004 | Wang | |
| 2006/0278690 | A1 | * | 12/2006 | Wang | 229/120.33 |
| 2007/0163977 | A1 | | 7/2007 | Wang | |
| 2007/0200470 | A1 | | 8/2007 | Wang | |
| 2013/0112740 | A1 | * | 5/2013 | Mcpeak | 229/120.38 |

* cited by examiner

SYSTEM AND APPARATUS FOR STORING AND ORGANIZING ITEMS

FIELD

Embodiments of the present invention are directed to a system and an apparatus for storing and organizing items. In more detail, embodiments of the present invention include a system and an apparatus operable to be configured in a plurality of variations, such that the system and the apparatus can store and organize various styles and sizes of items, such as footwear or other apparel.

BACKGROUND

Recent statistics indicate that an average person owns seventeen pairs of footwear, such as various combinations of tennis shoes, dress shoes, high-heel shoes, boots, or the like. Owning such a significant number of footwear can lead to organizational problems. For instance, it is common for footwear to be stored on a floor area of a person's bedroom or closet. However, storing footwear on a floor area can lead to the footwear becoming disorganized, cluttered, lost, and/or separated. Furthermore, the footwear can be damaged by being stepped on or by coming into contact with other objects stored nearby. Thus, it is beneficial to organize the footwear by storing the footwear in compartments that keep the footwear off the floor and together in pairs. Furthermore, it is beneficial if the compartments are operable to store the footwear in a manner that keeps the footwear readily viewable and easily accessible.

Numerous organization systems are currently available for organizing items, such as footwear, using compartments. Such systems may include systems of racks, drawers, and/or shelves. However, currently available systems are generally formed from rigidly formed materials, which do not provide for variability in sizing for the compartments. For instance, a shelving system made of wood may present a plurality of compartments that are sized such that a user may store and organize tennis shoe-sized footwear. However, if the user owns a pair of full-length boots, the user cannot fit the boots in the tennis shoe-sized compartments without folding and potentially damaging the boots. Furthermore, if a user has a system with a large compartment that is sized to hold a full-length pair of boots, such a compartment may present a waste of space should the user discard the full-length pair of boots and no longer have the need for the large compartment. Thus, present organization systems do not provide for the variability necessary to store and organize various types, styles, and sizes of items, nor do the systems have the capability to change compartment sizes in response to changes in the types, styles, and sizes of shoes owned by the user.

SUMMARY

Embodiments of the present invention are directed to a storage system that includes first and second spaced apart side panels; a top panel and a bottom panel that each extend between the side panels; a plurality of intermediate panels positioned between the side panels and between the top and bottom panels, with the intermediate panels defining a plurality of compartments; and at least one partition capable of being folded within at least one compartment to present at least three variations of sub-compartment arrangements within the compartment.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein:

FIG. 4(*b*) is a right-side perspective view of a partition according to embodiments of the present invention;

FIG. 5(*b*) is a right-side perspective sectional view of a rectangular-shaped compartment and a square-shaped compartment from the storage system of FIGS. 1-3, with the rectangular-shaped-compartment including the partition from FIGS. 4(*a*)-(*b*) secured therein;

Figure 1:
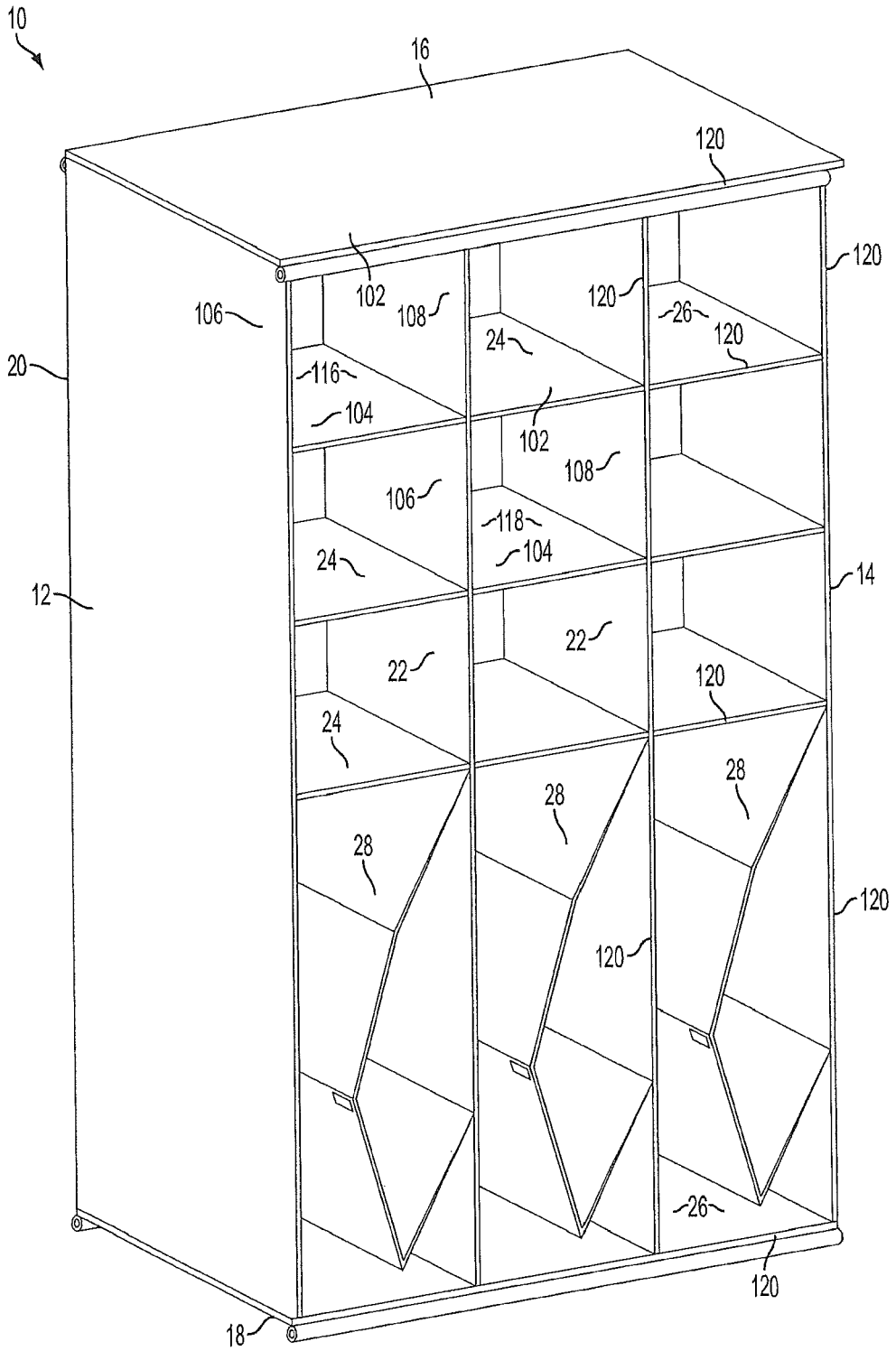
FIG. 1 is a perspective view of a storage system for storing and organizing items according to embodiments of the present invention, with the storage system including a first group of compartments that are square-shaped and a second group of compartments that are rectangular-shaped.

The drawing figures do not limit the present invention to the specific embodiments disclosed and described herein. The drawings are not necessarily to scale, emphasis instead being placed upon clearly illustrating the principles of the invention.

DETAILED DESCRIPTION OF THE EMBODIMENTS

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

Embodiments of the present invention are directed to a system and a method for organizing items. Such items may include, for instance, apparel, footwear, or other personal items. However, it is understood that such examples of items that can be organized according to embodiments of the present invention are not intended to be limiting, and embodiments of the present invention may be used to organize generally any type of item.

Figure 2:
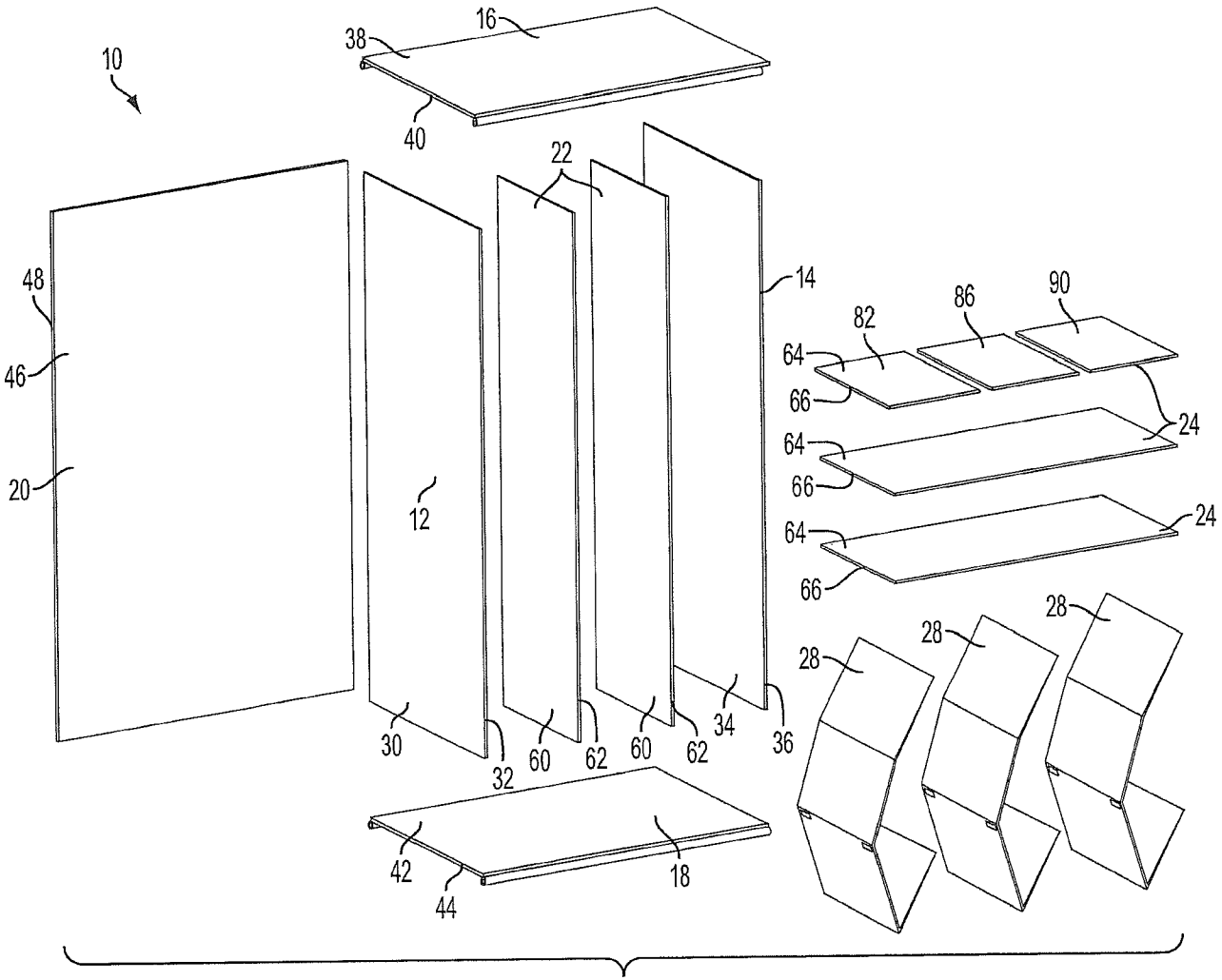
FIG. 2 is an exploded view of the storage system from FIG. 1.

Turning to the figures, FIGS. 1-2 illustrate an embodiment of a storage system 10 for storing and organizing items according to embodiments of the present invention, with the storage system broadly comprising a first vertical side panel 12 spaced apart from a second vertical side panel 14; a horizontal top panel 16 extending between the top portions of the side panels; a horizontal bottom panel 18 extending between bottom portions of the side panels; a vertical back panel 20 extending between rear portions of the side panels and between the rear portions of the top and bottom panels; a plurality of vertical intermediate panels 22 and horizontal intermediate panels 24, extending between the top and bottom panels and the side panels respectively, such that the top, bottom, side, and intermediate panels presenting a plurality of compartments 26 (a top right corner compartment and a bottom right corner compartment are provided with reference numerals 26 in FIG. 1 for illustration purposes); and one or more partitions 28 associated with one or more of the compartments in the plurality of compartments, with the partitions being foldable within the compartments to present multiple variations of sub-compartment arrangements within the compartments. In one embodiment, each of the partitions is capable of being folded within at least one compartment to present at least three variations of sub-compartment arrangements within the compartments. In another embodiment, each of the partitions is capable of being folded within at least one compartment to present at least four variations of sub-compartment arrangements within the compartments. Such embodiments of the present invention provide for multiple configurations of compartments to be presented, such that system and apparatus can accommodate various arrangements of items to be positioned within the compartments.

Figure 3:
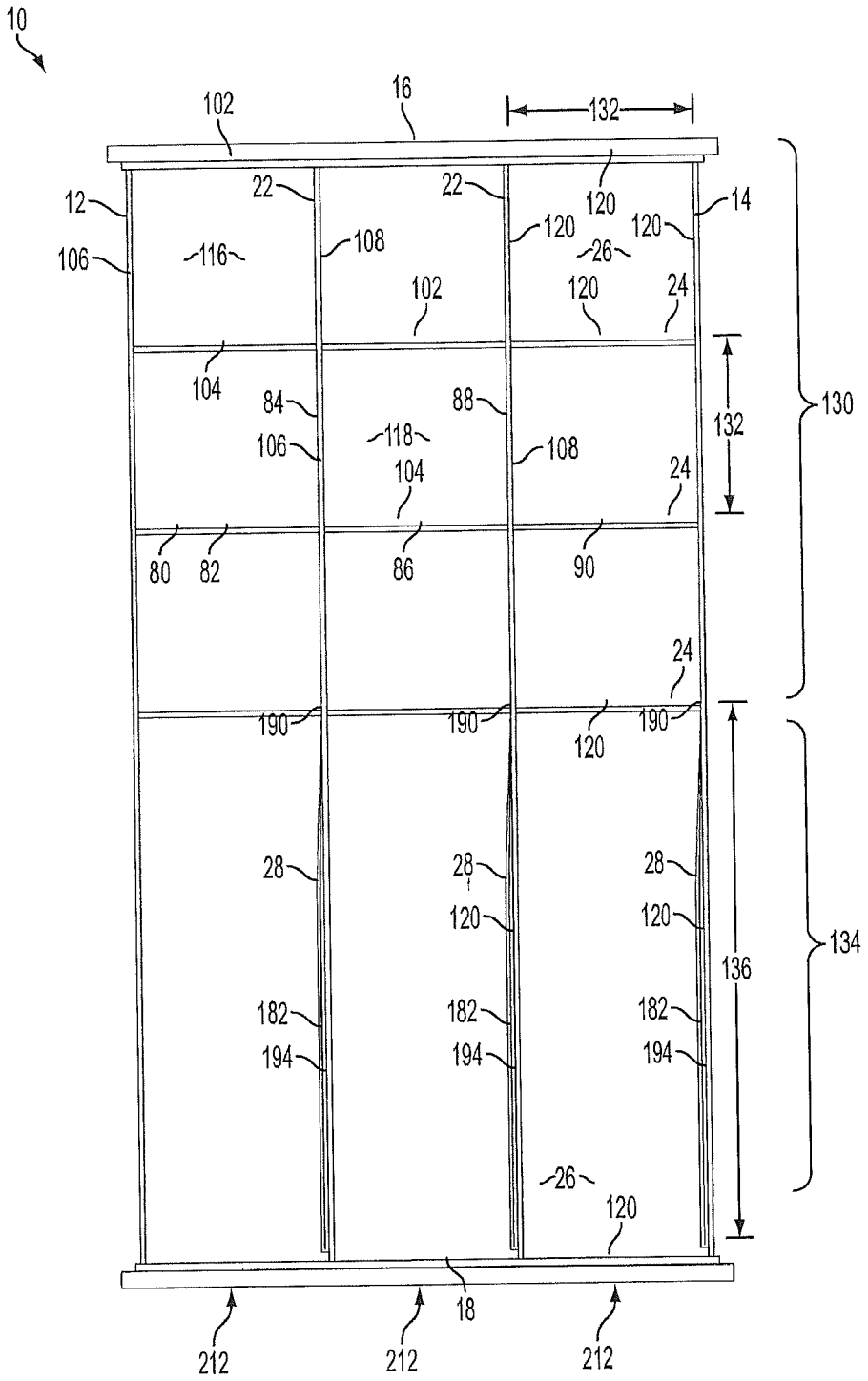
FIG. 3 is a front elevational view of the storage system from FIGS. 1-2.
Figure 7:
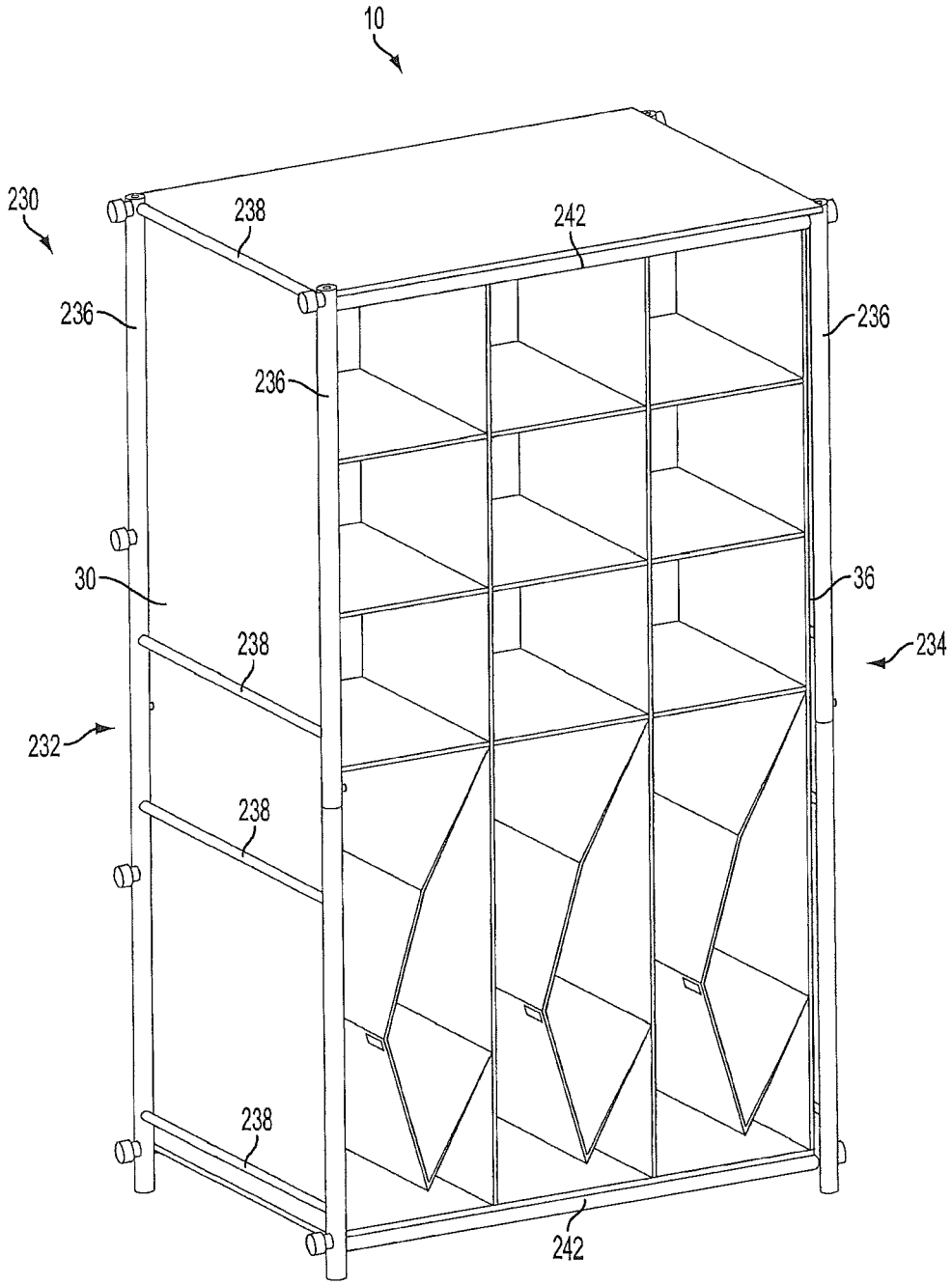
FIG. 7 is perspective view of the storage system from FIGS. 1-3, with support components attached thereto.

In certain embodiments, such as illustrated in the figures, the first and second side panels 12,14 may generally be shaped in the form of a rectangle. In such embodiments, the side panels will each have front, rear, top, and bottom edges. However, in other embodiments, the side panels 12,14 may be formed in other shapes, such as a rhomboid, a triangle, a circle, an oval, an ellipse, or the like. In still other embodiments, the first and second side panels 12,14 may be formed in shapes that are different from each other. With reference to FIG. 2, the first side panel 12 may include a left-facing side 30 and a right-facing side 32, and the second side panel 14 may include a left-facing side 34 and a right-facing side 36. In such embodiments, the right-facing side 32 of the first side panel 12 and the left-facing side 34 of the second side panel 12 face each other and face an interior portion of the storage system 10. Correspondingly, the left-facing side 30 of the first side panel 12 and the right-facing side 36 of the second side panel 14 may each face exterior to the storage system 10. As used herein, direction or relational terms such as "left side" or "right side" are used as an aid to the reader in place of less visual terms such as "first side" and "second side." The terms "left," "right," "up," "down," "front," and "back" are used in the context of a user viewing embodiments of the present invention from a frontal perspective, such as shown in FIGS. 1, 3, and 7.

Additionally, in certain embodiments, such as illustrated in the figures, the top and bottom panels 16,18 may generally be shaped in the form of a rectangle. In such embodiments, the top and bottom panels will each have front, rear, top, and bottom edges. However, in other embodiments, the top and bottom panels 16,18 may be formed in other shapes, such as a rhomboid, a triangle, a circle, an oval, an ellipse, or the like. In still other embodiments, the top and bottom panels 16,18 may be formed in shapes that are different from each other. With reference to FIG. 2, the top panel 16 may include an upward-facing side 38 and a downward-facing side 40, and the bottom panel 18 may include an upward-facing side 42 and a downward-facing side 44. In such embodiments, the downward-facing side 40 of the top panel 16 and the upward-facing side 42 of the bottom panel 18 face each other and face the interior portion of the storage system 10. Correspondingly, the upward-facing side 38 of the top panel 16 and the downward-facing side 44 of the bottom panel 18 may each facing exterior to the storage system 10.

Further, in certain embodiments, such as illustrated in figures, the back panel 20 may generally be shaped in the form of a rectangle. In such embodiments, the back panel will have front, rear, top, and bottom edges. However, in other embodiments, the back panel 20 may be formed in other shapes, such as a rhomboid, a triangle, a circle, an oval, an ellipse, or the like. With reference to FIG. 2, the back panel 20 may include a front-facing side 46 and a back-facing side 48, with the front-facing side of the back panel facing the interior portion of the storage system. Correspondingly, the back-facing side 48 of the back panel 20 may face exterior to the storage system.

Embodiments of the present invention, such as illustrated in figures, may provide for the plurality of vertical and horizontal intermediate panels 22,24 to generally be shaped in the form of rectangles. In such embodiments, the intermediate panels will each have front, rear, top, and bottom edges. However, in other embodiments, the intermediate panels 22,24 may be formed in other shapes, such as a rhomboid, a triangle, a circle, an oval, an ellipse, or the like. In certain embodiments, shapes of the vertical and horizontal intermediate panels 22,24 may correspond to the shapes of the side panels 12,14 and the top and bottom panels 16,18 respectively. With reference to FIG. 2, the vertical intermediate panels 22 may include left-facing sides 60 and right-facing sides 62. The horizontal intermediate panels 24 may include upward-facing sides 64 and downward-facing sides 66.

The vertical and horizontal intermediate panels 22,24 generally extend between the top and bottom panels 16,18 and the first and second side panels 12,14 respectively. For instance, in certain embodiments, the vertical intermediate panels 22 may extend between the top and bottom panels 16,18 such that each of the vertical intermediate panels are generally parallel with the first and second side panels 12,14. Similarly, the horizontal intermediate panels 24 may extend between the first and second side panels 12,14 such that each of the horizontal intermediate panels are generally parallel with the top and bottom panels 16,18. Because the vertical and horizontal intermediate panels 22,24 extend in different directions within the interior of the storage system 10, the vertical and horizontal intermediate panels will generally intersect with each other. In certain embodiments, the intermediate panels 22,24 may be formed such that the intermediate panels intersect with each other while maintaining a continuous extending structure. For example, the intermediate panels 22,24 may include gaps (not shown) through portions of the panels, such that portions of the intermediate panels can pass through the gaps as the panels intersect. In additional embodiments, a portion of the intermediate panels 22,24 may be formed from a permeable material (not shown), such as loosely bound threading, such that portions of the intermediate panels can pass through the loosely bound threading as the panels intersect. Such embodiments provide for each of the vertical and horizontal intermediate panels 22,24 to generally extend in a continuous manner from between the top and bottom panels 16,18 and the side panels 12,14, respectively, while the panels intersect with each other. In addition to the examples discussed above, embodiments of the present invention contemplate the use of other manners of intersection that permit the intermediate panels 22,24 to intersect while extending within the storage system 10 in generally in a continuous manner.

In certain other embodiments, the intermediate panels 22,24 may not completely intersect, but one or more of the intermediate panels may instead be made up of multiple individual segments, with each of the individual segments extending between and joining with other intermediate panels. For instance, as illustrated by FIGS. 1-3, embodiments of the present invention may include two vertical intermediate panels 22 extending continuously from the top panel 16 to the bottom panel 18. Additionally, embodiments may include one or more horizontal intermediate panels 24 that extend between the first and second side panels 12,14; however, such horizontal intermediate panels may not extend entirely continuously. Instead, the horizontal intermediate panels 24 may each comprise multiple individual segments that extend between and join with the side panels 12,14 and the vertical intermediate panels 22. For instance, with reference to the embodiment shown in FIG. 3 and elements 82, 86, and 90 of FIG. 2, a central horizontal intermediate panel 80 of the horizontal intermediate panels 24 may include a first segment 82 that extends from the first side panel 12 to a left-most vertical intermediate panel 84 of the vertical intermediate panels 22. The central horizontal intermediate panel 80 may additionally include a second segment 86 that extends between the left-most vertical intermediate panel 84 and a right-most vertical intermediate panel 88. Finally, the central horizontal intermediate panel 80 may include a third segment 90 that extends between the right-most vertical intermediate panel 88 and the second side panel 14. However, it is understood that the number of segments is dependent on the number of intermediate panels 22,24 in the plurality of intermediate panels, such that, in the previous example, if embodiments included more than two vertical intermediate panels, the central horizontal intermediate panel 80 would include more than three segments. Further, it is understood that the horizontal intermediate panels 24 may extend continuously between the first and second side panels 12,14 and the vertical intermediate panels 22 may comprise multiple segments extending between and joining with the top panel 16, the horizontal intermediate panels 24, and the bottom panel 18. Still further, the vertical and horizontal intermediate panels 22,24 may include various combinations of continuous and segmented extensions between the top and bottom 16,18 and the side panels 12,14 respectively.

Regardless of how the intermediate panels 22,24 intersect or join with each other, the intermediate panels 22,24, the side panels 12,14, the top panel 16, the bottom panel 18, and back panel 20 join to present a plurality of compartments 26, such as illustrated in FIGS. 1 and 3 (Only the top right corner compartment and the bottom right corner compartment are illustrated with reference numerals 26). The panels may be secured to each other. As used herein, the terms "secure," "secured," and "securement" includes methods and means of permanent attachment and detachable attachment. Permanent methods of securement may include, for instance, sewing, stitching, heat-welding, permanent adhesives, or the like. Detachable methods of securement may include, for instance, hook-and-loop fasteners, button-snap fasteners, hook-and-eye clasps, zip fasteners, or the like. The number of compartments 26 in the plurality of compartments is dependent on the number of vertical and horizontal intermediate panels 22,24 included in the storage system 10. For instance, the embodiments illustrated in FIGS. 1-3 includes two vertical intermediate panels 22 and three horizontal intermediate panels 24, which presents twelve compartments 26. However, embodiments with more intermediate panels 22,24 would result in a more compartments 26, while embodiments with fewer intermediate panels would result in fewer compartments. In the embodiments illustrated in the figures, the compartments are generally rectangular and/or square-shaped. Such rectangular and/or square shapes are resultant from the intermediate panels 22,24 extending generally vertically and horizontally. However, embodiments of the present invention may additional include intermediate panels 22,24 that are not vertical and/or horizontal, such that the resultant compartments 26 may be triangular, rhomboidal, or any other geometrical shape.

In embodiments in which the compartments 26 are rectangular and/or square-shaped, each of the compartments in the plurality of compartments has four side walls comprising a top side wall 102, a bottom side wall 104, a left side wall 106, and a right side wall 108 (such side walls are illustrated in FIGS. 1 and 3 with respect to an exemplary compartment-A and an exemplary compartment-B described in more detail below). Each of the side walls of a given compartment 26 is formed by a portion of the first and second side panels 12,14, the top panel 16, the bottom panel 18, and/or the intermediate panels 22,24. For instance, compartments positioned adjacent to outer portions of the interior of the storage system 10 may include portions of top panels 16, bottom panels 18, side panels 12,14, and/or intermediate panels 22,24 as side walls. Contrastingly, compartments positioned at inner portions of the interior of the storage system 10 may include only portions of intermediate panels 22,24 as side walls. For example, with reference to FIG. 3 compartment-A 116 located in an upper left corner of the storage system 10 includes a portion of the first side panel 12 as its left side wall 106, a portion of the top panel 16 as its top side wall 102, portions of a vertical intermediate panel 22 as its right side wall 108, and a portion of a horizontal intermediate panel 24 as its bottom side wall 104. Contrastingly, compartment-B 118 located diagonally from compartment-A includes vertical intermediate panels 22 as its left and right side walls 106,108 and horizontal intermediate panels 24 as its top and bottom side walls 102, 104. Each of the side walls of a compartment 26 join with an adjacent side wall at a corner of the compartments. In embodiments of the present invention in which the compartments 26 are rectangular or square-shaped, the compartment will include two upper corners and two lower corners.

Embodiments of the present invention provide for the top, bottom, left, and right side walls 102,104,106,108 of each compartment 26 to each include a front edge 120 (such front edges are illustrated in FIGS. 1 and 3 with respect to the exemplarily illustrated top right corner and bottom right corner compartments 26), with the front edges of the side walls presenting an opening to the compartment. Each compartment has a size that is defined as an area enclosed the front edges 120 of the side walls of the compartment 26. For example, exemplary top right corner compartment 26 has a first size enclosed by its front edges 120, which present a square-shaped opening. Contrastingly, exemplary bottom right corner compartment 26 has a second size enclosed by its front edges 120, which present a rectangular-shaped opening. With reference to FIG. 3, certain embodiments may include a first group 130 of one or more of the compartments in the plurality of compartments 26 that each have side walls with front edges 120 that are of a first length 132, such that the openings of the compartments in the first group are generally square-shaped and further such that the sizes of each of the compartments are all generally equal. Exemplary square-shaped compartments in the first group 130 are illustrated by the top nine compartments in FIG. 3. Certain other embodiments may include a second group 134 of one or more of the compartments in the plurality of compartments each having two of the four side walls that are of a second length 136, with the other two of their four side walls being of the first length 132, and further wherein the second length 136 is greater than the first length 132, such that the openings of the compartments in the second group are generally rectangular shaped. Exemplary rectangular-shaped compartments in the second group are illustrated by the bottom three compartments in FIG. 3. In certain embodiments, the second length 136 of the compartments in the second group 134 may be between about two, three, four, five, or more times the first length 132. Correspondingly, in such embodiments, the size of the compartments in the second group 134 may be larger than the size of the compartments in the first group 130. In certain embodiments, the compartments in the second group 134 may be two, three, four, five, or more times the size of the compartments in the first group 130.

Figure 4A:
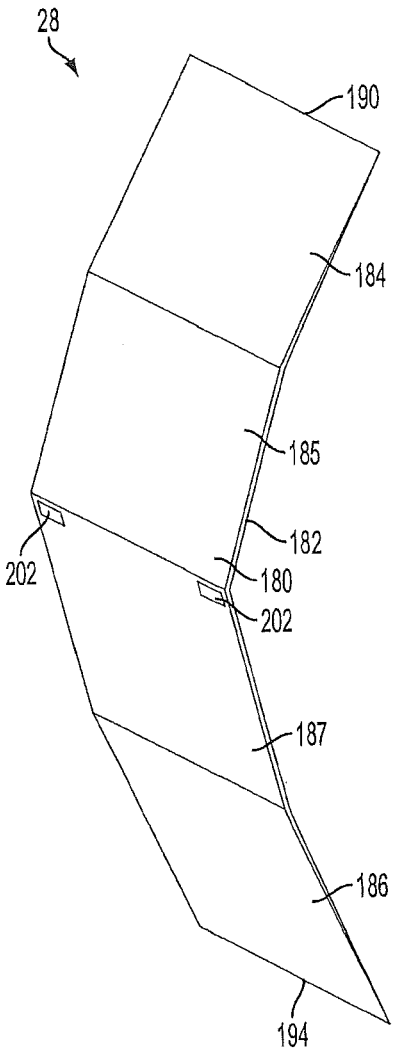
FIG. 4(*a*) is a left-side perspective view of a partition according to embodiments of the present invention.
Figure 4B:
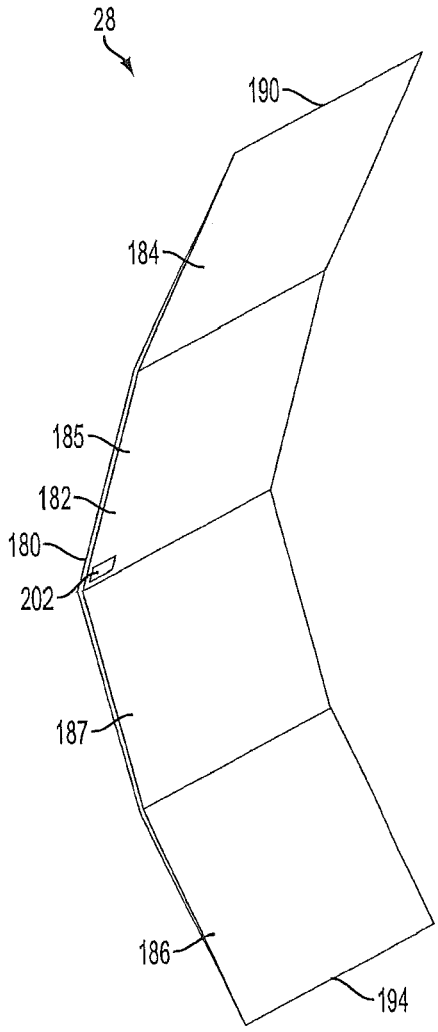

Embodiments of the present invention may provide for at least one partition 28 to be associated with the at least one of the compartments 26. Certain embodiments may provide for all of the compartments 26 to include partitions 28. However, in other embodiments, only the compartments 26 in the second group 134 of compartments may have partitions 28. As illustrated in FIGS. 4(*a*)-(*b*), the partitions 28 may be formed of four sections of semi-rigid material, with each of the sections being free to rotate or bend with respect to an adjacent section. The partitions may include left and right-facing sides 180,182. In certain embodiments, the four sections may be aligned linearly to define two outer panels and two inner panels. The two outer panels include a first outer panel 184 that presents a first exterior edge 190 of the partition 28 and a second outer panel 186 that presents a second exterior edge 194. The two inner panels may include a first inner panel 185 adjacent to the first outer panel 184 and a second inner panel 187 adjacent to the second outer panel 186. In such embodiments, lengths of each of the sections of the partition 28 may correspond with the lengths of the side panels of the compartments in the first group of compartments (i.e., the first length 132), such that a total length of the partition is about four times the length of the first length. However, it should be understood that the partition 28 may include more than four sections, and/or each of the four sections may have a length that is longer or shorter than the first length 132. As a result, certain embodiments may provide for the length of the partition 28 to be between about two, three, four, five, or more times a length of the first length 132. As will be described in more detail below, the partition 28 is capable of being folded within a compartment 26 to present multiple variations of sub-compartment arrangements within the compartment. Such folding capabilities are due, in part, to the ability of each of the sections of the partition 28 to rotate or bend with respect to an adjacent section. However, embodiments of the present invention further contemplate that the partition 28 may be formed from a single section of material that is capable of bending and holding its shape, such as a shape-memory alloy.

Figure 5A:
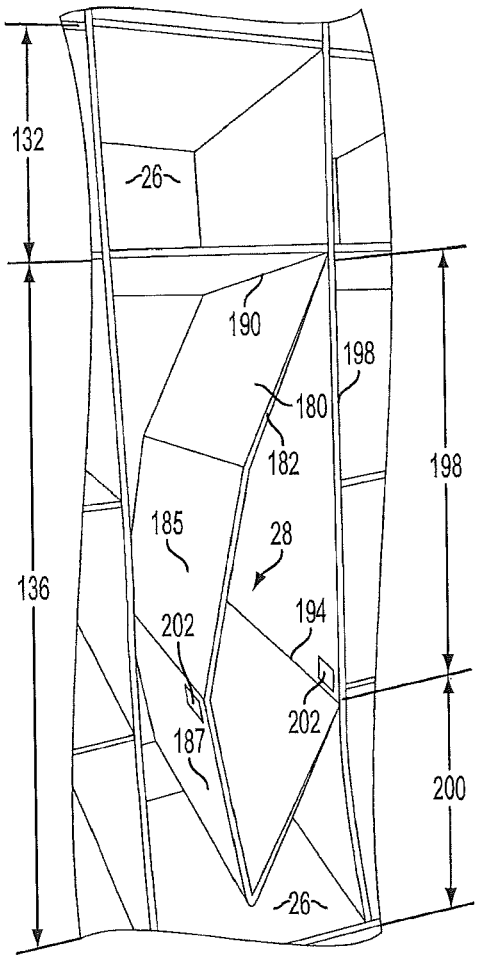
FIG. 5(*a*) is a left-side perspective sectional view of a rectangular-shaped compartment and a square-shaped compartment from the storage system of FIGS. 1-3, with the rectangular-shaped-compartment including the partition from FIGS. 4(*a*)-(*b*) secured therein.
Figure 5B:
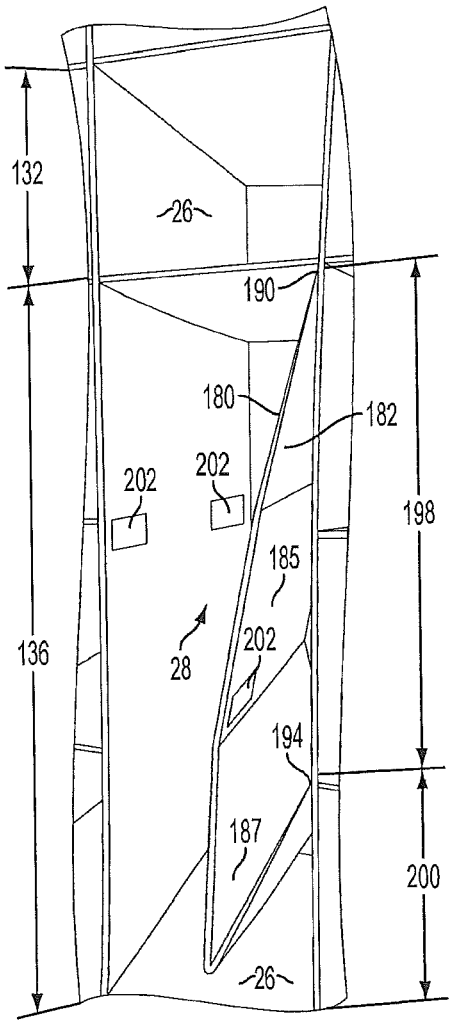

The partitions 28 may be secured within the compartments 26 via various methods of securement and in a plurality of positions. For instance, certain embodiments may provide for the first exterior edge 190 of the partition 28 to be secured within a compartment 26 at position adjacent to a joining of two panels presenting two side walls of the compartment. In certain embodiments, such as illustrated in FIGS. 5(*a*)-(*b*), the first exterior edge 190 may be secured at an upper corner of the compartment 26. Remaining with FIGS. 5(*a*)-(*b*), embodiments may additionally provide for the second exterior edge 194 of the partition 28 to be secured to a panel that forms a side wall of a compartment 26. Certain embodiments may provide for the second exterior edge 194 to be secured to the side wall at position that is a first distance 198 from the position at which the first exterior edge 190 is secured within the compartment 26. In embodiments in which the partition 28 is associated with a compartment from the second group 134 of compartments (i.e., the rectangular-shaped compartments), and with such compartment having the second length 136 that is approximately three times the length of the first length 132, such as the embodiment illustrated in FIGS. 5(*a*)-(*b*), the second exterior edge 194 of the partition may be secured to the side wall of the compartment, such that the first distance 198 is approximately two times the first length 132. In such embodiments, if the first exterior edge 190 is secured to an upper corner of the compartment 26, then the position at which the second exterior edge 194 is secured to the side wall is also separated from a bottom corner of the compartment at a second distance 200 that is about equal to the first length 132.

The exterior edges 190,194 may be permanently or detachable secured within the compartment 26. Permanent methods of securement may include, for instance, sewing, stitching, heat-welding, permanent adhesives, or the like. Detachable methods of securement may include, for instance, hook-and-loop fasteners, button-snap fasteners, hook-and-eye clasps, zip fasteners, or the like.

In addition to the exterior edges 190,194 of the partition 28 being secured within the compartment 26, the partition may be secured within compartment by having a portion of the left and/or right-facing sides 180,182 secured to the side walls of the compartment. As with the exterior edges 190,194 discussed above, the left and/or right-facing sides 180,182 of the partitions 28 may be permanently or detachably secured. For example, with reference to FIGS. 5(*a*)-(*b*) the first and second inner panels 185, 187 of the partition 28 may include hook-and-loop fastener material 202 on portions of their left and right-facing sides 180,182. Similarly, portions of the side walls of the compartment 26 may have hook-and-loop fastener material 202 located thereon. As a result, the first and second inner panels 185, 187 of the partition 28 may be secured to the side walls of the compartment 26 at positions where the hook-and-loop fastener material 202 of the partition and the side walls align to keep the partition secured in place within the compartment at a specific orientation.

Certain embodiments of the present invention may provide for the partition 28 to be folded within a compartment 26 to create at least four variations of sub-compartment arrangements within the compartment. Other embodiments of the present invention provide for the partition 28 to be folded within a compartment 26 to create at least three variations of sub-compartment arrangements within the compartment. As previously described, FIGS. 5(*a*)-(*b*) illustrate an example of a rectangular-shaped compartment in the second group 134 of compartments that has a second length 136 that is about three times the length of the first length 132. The rectangular-shaped compartment may have secured therein a partition 28, with the partition's first exterior edge 190 secured to an upper corner of the compartment and the partition's second exterior edge 194 secured to a right side wall 108 of the compartment at a position that is a first distance 198 from the upper corner at which the first exterior edge is secured. In addition, the left and right-facing sides 180,182 of the partition 28 and the side walls of the compartment 26 may further include detachable methods of securement positioned thereon. As a result of such methods of securement, the partition 26 may be folded and secured within the compartment 26 to present a plurality of sub-compartment variations.

For instance, with reference to FIG. 3, partitions 28 may be secured within the rectangular-shaped compartments in the second group 134 of compartments to form first variations 212 of sub-compartments within each of the rectangular-shaped compartments. Such sub-compartments each comprise one sub-compartment, with an opening of each of the sub-compartments having a size that is generally equivalent to a size of the opening of a compartment in the second group 134 of compartments. In such an embodiment, in addition to the first and second exterior edges 190,194 of the partitions 28 being secured within the compartments, a portion of the right-facing side 182 of the partitions may be secured to side wall of the compartments to keep the partitions in place to form the first variations 212. For example, the partitions 28 may be attached to the side walls via the hook-and-loop material 202 (not shown in FIG. 3) located on the right-facing sides 182 of the partitions and on the side walls of the compartments.

Figure 6:
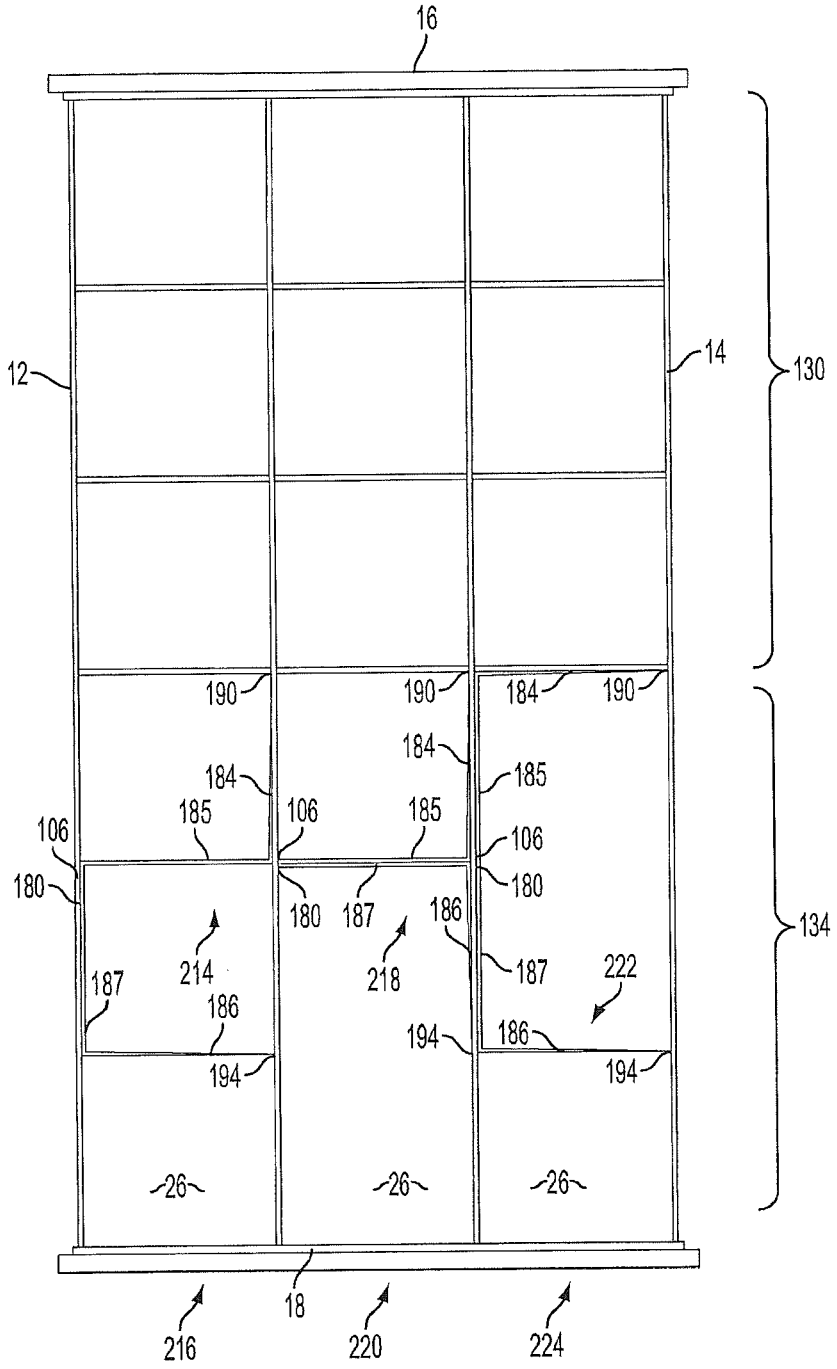
FIG. 6 is a perspective view of the storage system from FIGS. 1-3 with the partition from FIG. 4 included in each of the rectangular-shaped compartments to present a plurality of sub-compartment variations.

With reference to FIG. 6, a first exemplary partition 214 (including each of its first and second outer panels 184,186 and first and second inner panels 185,187) of the partitions 28 may be folded within a compartment 26 in the second group 134 of compartments to form a second variation 216 comprising three sub-compartments, wherein openings of the three sub-compartments of the second variation have sizes that are generally equivalent. In certain embodiments the openings of the three sub-compartments may be generally the same as the sizes of the openings of the compartments in the first group 130 of compartments. Furthermore, the sub-compartments may be square-shaped. In such embodiments, in addition to the first and second exterior edges 190,194 of the first exemplary partition 214 being secured within the compartment 26, a portion of the left-facing side 180 of the second inner panel 187 of the partition may be secured to the left side wall 106 of the compartment to keep the partition in place to form the first variation 216. The partition 214 may be secured to the side wall via, for instance, the hook-and-loop fastener material 202 (not shown in FIG. 6).

Remaining with FIG. 6, a second exemplary partition 218 (including each of its first and second outer panels 184,186 and first and second inner panels 185,187) may be folded within a compartment 26 in the second group 134 of compartments to form a third variation 220 comprising two sub-compartments, with a first sub-compartment of the two sub-compartments having an opening approximately twice the size of an opening of a second sub-compartment. Furthermore, in the third variation 220, the first sub-compartment is positioned below the second sub-compartment. In certain embodiments, the opening of the first sub-compartment may have a size that is generally equivalent to twice the size of the openings of the compartments in the first group 130 of compartments. In addition, in other embodiments, the opening of a second sub-compartment may have a size that is generally equivalent to the size of the opening of a compartment in the first group 130 of compartments. Furthermore, the first sub-compartment may be rectangular-shaped, and the second sub-compartment may be square-shaped. In such embodiments, in addition to the first and second exterior edges 190,194 of the second exemplary partition 218 being secured within the compartment 26, a portion of the left-facing side 180 of the partition may be secured to the left side wall 106 of the compartment to keep the partition in place to form the third variation 220. The partition 218 may be secured to the side wall via, for instance, the hook-and-loop fastener material 202 (not shown in FIG. 6).

Still remaining with FIG. 6, a third exemplary partition 222 (including each of its first and second outer panels 184,186 and first and second inner panels 185,187) may be folded within a compartment 26 in the second group 134 of compartments to form a fourth variation 224 comprising two sub-compartments, with a first sub-compartment of the two sub-compartments having an opening approximately twice the size of an opening of a second sub-compartment. Furthermore, in the fourth variation 224, the first subcompartment is positioned above the second sub-compartment. In certain embodiments, the opening of the first sub-compartment may have a size that is generally equivalent to twice the size of the openings of the compartments in the first group 130 of compartments. In addition, or in other embodiments, the opening of the second sub-compartment may have a size that is generally equivalent to the sizes of the openings of the compartments in the first group 130 of compartments. Furthermore, the first sub-compartment may be rectangular-shaped, and the second sub-compartment may be square-shaped. In such an embodiment, in addition to the first and second exterior edges 190,194 of the third exemplary partition 222 being secured within the compartment 26, a portion of the left-facing side 180 of the partition may be secured to the left side wall 106 of the compartment to keep the partition in place to form the fourth variation 224. The partition 222 may be secured to the side wall via, for instance, the hook-and-loop fastener material 202 (not shown in FIG. 6).

It should be understood that although the above examples were provided with respect to the individual partitions (i.e., the first, second, and third exemplary partitions 214, 218, 222) included in individual compartments 26, all partitions 28 are operable to be folded within an individual compartment to form any and all variations described above or that may be required. Thus, each partition 28 can be folded within a compartment 26 to create at least four variations of sub-compartment arrangements. Furthermore, such variations are provided for exemplary purpose only, and the partition 28 may be formed, such that it can be folded within the compartment to present any number and sizes of sub-compartments as may be required.

By allowing for the system to include multiple variations of sub-compartment arrangements, a user can manipulate the partitions 28 within the compartments 26 to form the appropriate sub-compartment(s) needed to store and organize any shape, type, and/or size of item. As an illustrative example, a user can place a tennis shoe-sized pair of shoes into a sub-compartment that has a similar size as a compartment 26 from the first group 130 of compartments. Additionally, a user can place a pair of full-length boots into a sub-compartment that has a similar size as a compartment 26 from the second group 134 of compartments. Further, a user can place a pair of medium-length boots into a sub-compartment that has a size approximately equal to twice that of a compartment 26 from the first group 130 of compartments. Thus, by manipulating a partition 28 within a compartment 26, a user can form multiple variations of sub-compartment(s) arrangements to hold any type, style, and/or size of footwear that the user may need to store and/or organize.

The panels (i.e., the sides 12,14, the top 16, the bottom 18, the back 20, and the intermediate 22,24) and the partitions 28 of embodiments of the present invention may be made from a flexible material. The flexible materials may include natural materials, such as cotton, denim, leather, or the like. The flexible materials may further include synthetic materials, such as nylon, polyester, elastane, or the like. In certain embodiments, certain portions of the panels and/or the partitions may additionally be formed from rigid materials in addition to the flexible materials. The rigid materials may include for instance cardboard, polystyrene foam, or the like. The rigid materials may provide structural support for embodiments of the present invention or they may provide support for items that are positioned within the compartments 26 and/or sub-compartments presented by the panels and/or partitions. In embodiments that include the rigid materials, the flexible material of the panels and/or the partitions may be formed to surround the rigid materials, such that the rigid materials are encased in the flexible material.

In embodiments that do not include the rigid materials, or that only include a portion of the panels (i.e., the sides 12,14, the top 16, the bottom 18, the back 20, and the intermediate 22,24) and/or partitions 28 with rigid materials, the storage system 10 may be fully collapsible. Such embodiments may provide for the storage system 10 to be collapsed into a smaller size for storage and/or transport purposes. In embodiments in which each of the panels and/or partitions includes rigid materials, the storage system 10 may be operable to be structurally self-supporting, such that storage system can support itself (via the panels) on a floor, or other flat surface.

Figure 8:
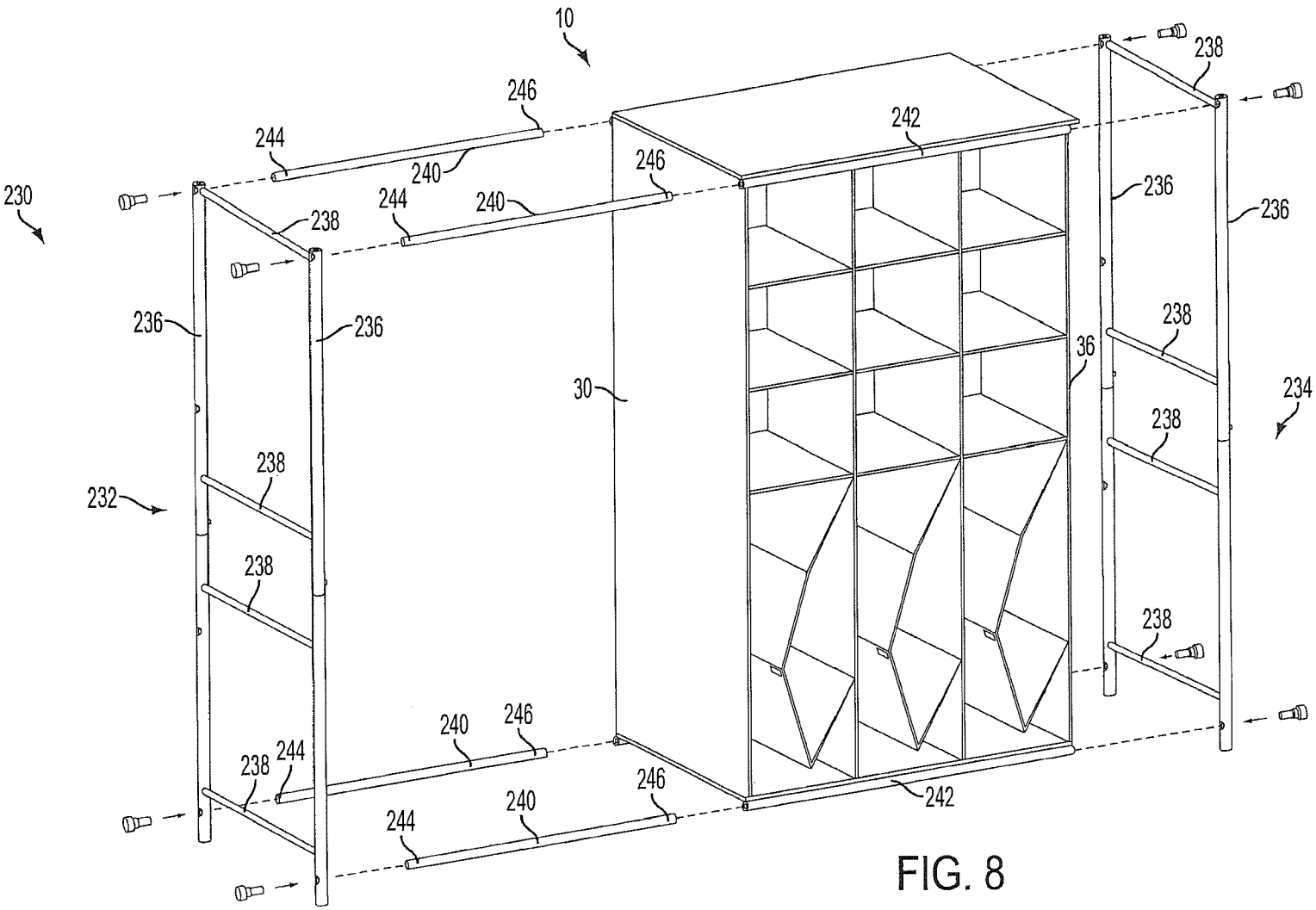
FIG. 8 is an exploded view of the support components from FIG. 7 shown with the storage system from FIGS. 1-3 and 7.

Embodiments of the present invention may additionally include support components to stably and/or structurally support the storage system 10. As illustrated by FIGS. 7-8, embodiments may provide for a support component assembly 230 that comprise a first side support bracket 232 and a second side support bracket 234 positioned adjacent to the left-facing side 30 of the first side panel 12 and the right-facing side 36 of the second side panel 14, respectively. The side support brackets 232,234 may have the form of a ladder shape, such that each of the support brackets includes two vertically-orientated support members 236 with one or more horizontally-oriented support members 238 that extend between the vertically oriented support members. The support component assembly 230 may additionally include one or more lateral support members 240 that extend between the first and second side support brackets 232,234. In such embodiments, the top and bottom panels 16,18 may further include tubular sections 242 positioned adjacent to each of their front and rear edges. The lateral support members 240 may include left ends 244 and right ends 246, with a left end of each of the lateral support members being connectable to the first side support bracket 232 and a right end of each of the lateral support members being connectable to the second side support bracket 234. Furthermore, a diameter of the lateral support members 240 may be sized such that an individual lateral support member can be positioned within one of the tubular sections 242. As a result, the lateral support members 240 may be positioned within the tubular sections 242 and have their ends connected to the side support brackets, such that the laterals support members are further operable to stably support the storage system 10 as it is positioned on a floor, or other flat support area.

In addition to, or alternatively, the support component assembly 230 that supports the storage system 10 from a flat support area (i.e., a floor), embodiments of the present invention may provide for the storage system 10 to be supported in a hanging position. For instance, embodiments may include a tubular hanging section (not shown) positioned on an upper-facing side 38 of the top panel 16, with the tubular hanging section extending along an entire length of the top panel, from generally about the first side panel 12 to about the second side panel 14. The tubular hanging section may have a diameter sized such that a closet hanging rod (not shown) can be inserted through and maintained within the tubular hanging section. As such, the system can be hung in a closet for use in storing and organizing items. In additional embodiments, the top panel 16 may include one or more straps (not shown) with latches, buckles, hooks, or other methods of securement, such that the storage system 10 can be hung and supported for use.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

1. A storage system comprising:

first and second spaced apart side panels;

a top panel extending between said side panels;

a bottom panel extending between said side panels;

a plurality of intermediate panels positioned between said side panels and between said top and bottom panels, said intermediate panels defining a plurality of compartments; and at least one partition formed of four panels, each of said at least one partition foldable within one of said plurality of compartments to provide at least three different variations of quadrilateral sub-compartment arrangements within said one of said plurality of compartments.

2. The storage system of claim 1, wherein said at least one partition is capable of folding to present a sub-compartment arrangement comprising one sub-compartment of a size that is generally equivalent to the size of said one of said plurality of compartments.

3. The storage system of claim 1, wherein said at least one partition is capable of folding to present a sub-compartment arrangement comprising a first sub-compartment and a second sub-compartment.

4. The storage system of claim 1, wherein said at least one partition is capable of folding to present a sub-compartment arrangement comprising a first-sub-compartment, a second sub-compartment, and a third sub-compartment.

5. The storage system of claim 1, wherein said one of said plurality of compartments is rectangular and said at least one partition is capable of folding to present a first sub-compartment that is generally square and a second sub-compartment that is generally rectangular.

6. The storage system of claim 1, wherein said one of said plurality of compartments is rectangular and said at least one partition is capable of folding to divide said one of said plurality of compartments into three sub-compartments of generally equal size.

7. The storage system of claim 1, wherein said at least one partition is secured within said one of said plurality of compartments.

8. The storage system of claim 1 wherein said one of said plurality of compartments is defined by a plurality of side walls, wherein said four panels are aligned linearly and comprise two outer panels and two inner panels, and wherein each of said two outer panels are secured to one of the plurality of side walls and one of said two inner panels is removably secured to at least one of the plurality of side walls depending upon the sub-compartment arrangement.

9. The storage system of claim 1, further comprising a frame which supports said side, top, bottom, and intermediate panels.

10. A storage system comprising:

first and second spaced apart vertical side panels;

a horizontal top panel extending between said side panels;

a horizontal bottom panel extending between said side panels;

a vertical back panel extending between said side panels;

a plurality of vertical and horizontal intermediate panels positioned between said side panels and between said top and bottom panels, said vertical and horizontal intermediate panels defining a plurality of compartments; and at least one partition secured within at least one compartment, said at least one compartment defined by three or more side walls, wherein said at least one partition has a top edge and a bottom edge and wherein said at least one compartment has a corner defined by an intersection of two of said three or more side walls, wherein said top edge of said at least one partition is secured to said upper corner of said at least one compartment and said bottom edge of said at least one partition is secured to one of said three or more side walls of said at least one compartment, wherein a length of said at least one partition is greater than a length of each of said three or more side walls of said at least one compartment, such that said at least one partition can be folded within said at least one compartment to present at least three variations of quadrilateral sub-compartment arrangements within said at least one compartment when said top edge and said bottom edge of said at least one partition are secured.

11. The storage system of claim 10, wherein said compartment additionally has a second corner defined by another intersection of two of said three or more side walls, and wherein said bottom edge of said partition is secured to said side wall of said compartment at a position located a distance above the second corner of said compartment.

12. The storage system of claim 10, wherein said at least one partition is formed of four panels of semi-rigid material.

13. The storage system of claim 12, wherein said four panels are aligned linearly to define two outer panels and two inner panels, and wherein at least one of said two inner panels is removably secured to one of said three or more side walls within said at least one compartment depending upon the desired sub-compartment arrangement.

14. The storage system of claim 10, further comprising a frame that supports said side, top, bottom, and intermediate panels.

15. A storage system comprising:

first and second spaced apart side panels;

a top panel extending between said side panels;

a bottom panel extending between said side panels;

a plurality of vertical and horizontal intermediate panels positioned between said side panels and between said top and bottom panels, wherein said side, top, bottom, and intermediate panels join to present a plurality of compartments; and at least one partition secured within at least one compartment, with said at least one partition having a first edge and a second edge and with said at least one compartment having three or more panels, wherein said first edge of said at least one partition is secured to a joining of two of said three or more panels within said at least one compartment and said second edge is secured to one of said three or more panels at a position located a distance from said secured first edge, wherein said at least one partition can be folded into at least three variations of quadrilateral sub-compartment arrangements within said at least one compartment with said first and said second edges being secured.

16. The storage system of claim 15, wherein said at least one partition is capable of folding to present one sub-compartment of a size that is generally equivalent to a size of said at least one compartment.

17. The storage system of claim 15, wherein said at least one compartment is rectangular and said at least one partition is capable of folding to form a first sub-compartment that is generally square and a second sub-compartment that is generally rectangular.

18. The storage system of claim 15, wherein said at least one compartment is rectangular and said partition is capable of folding to divide said at least one compartment into three sub-compartments of generally equal size.

* * * * *